US005862682A

United States Patent [19]

Maenaka et al.

[11] Patent Number: 5,862,682

[45] Date of Patent: Jan. 26, 1999

[54] METHOD AND APPARATUS FOR CONTROLLING NEEDLE DRIVING MOTORS IN A KNITTING MACHINE

[75] Inventors: Koyu Maenaka; Nobuhiro Araki; Makoto Takashima, all of Ishikawa-ken, Japan

[73] Assignee: Tsudakoma Kogyo Kabushiki Kaisha, Japan

[21] Appl. No.: 850,230

[22] Filed: May 2, 1997

[30] Foreign Application Priority Data

Jul. 26, 1996 [JP] Japan ..... 8-214127

[51] Int. Cl.[6] ..... D04B 7/28; D04B 15/99

[52] U.S. Cl. ..... 66/75.2; 66/218; 66/232; 364/470.12

[58] Field of Search ..... 364/470.12; 66/218, 66/75.2, 232

[56] References Cited

U.S. PATENT DOCUMENTS 3,867,820 2/1975 Zamarco et al. ..... 66/154 A
3,908,406 9/1975 Maler et al. ..... 66/154 A
4,774,819 10/1988 Goller et al. ..... 66/75.2
4,790,149 12/1988 Weingartner et al. ..... 66/75.2
4,841,748 6/1989 Watanabe et al. ..... 66/218

FOREIGN PATENT DOCUMENTS 3-74192 3/1991 Japan .

*Primary Examiner*—Andy Falik
*Attorney, Agent, or Firm*—Webb Ziesenheim Bruening Logsdon Orkin & Hanson, P.C.

[57] ABSTRACT

A method and apparatus for controlling needles of a knitting machine based upon comparing a plurality of predetermined position control patterns defining target positions with the position of a yarn feeder and a needle. When the positions are not the same, each needle is incrementally moved based upon the present position of the needle and the determined target position of the needle.

6 Claims, 5 Drawing Sheets

FIG.2(A)

| YARN FEEDER 1 | NEEDLE NUMBER | | | | |
|---|---|---|---|---|---|
| | N1 | N2 | ·· ·· | Nn-1 | Nn |
| COURSE 1 | PATTERN A | PATTERN A | ·· ·· | B | A |
| COURSE 2 | A | A | ·· ·· | B | A |
| ⋮ | ⋮ | ⋮ | ⋮ | ⋮ | ⋮ |
| COURSE N-1 | B | B | ·· ·· | B | B |
| COURSE N | B | B | ·· ·· | A | A |

FIG.2(B)

| YARN FEEDER 2 | NEEDLE NUMBER | | | | |
|---|---|---|---|---|---|
| | N1 | N2 | ·· ·· | Nn-1 | Nn |
| COURSE 1 | PATTERN A | PATTERN A | ·· ·· | A | A |
| COURSE 2 | A | A | ·· ·· | A | A |
| ⋮ | ⋮ | ⋮ | ⋮ | ⋮ | ⋮ |
| COURSE M-1 | B | B | ·· ·· | A | A |
| COURSE M | A | A | ·· ·· | B | B |

METHOD AND APPARATUS FOR CONTROLLING NEEDLE DRIVING MOTORS IN A KNITTING MACHINE

BACKGROUND OF THE INVENTION

1. Field of the Invention

The present invention relates to a method and apparatus for controlling a plurality of motors for reciprocating needles, included in a knitting machine.

2. Prior Art

A knitting machine having a plurality of needles is provided with motors, such as linear motors, servo-motors or stepping motors, respectively for the needles. One motor controller for a knitting machine provided with a plurality of motors, is proposed in Japanese Patent Application Disclosure No. 3-74192. The controller is provided with a multiple input/output chip having a signal generating unit and an up/down counter for each motor, and a microprocessor having a command unit and a control processing unit.

In this prior art motor controller, each up/down counter of the multiple input/output chip calculates a position of each corresponding motor, and each signal generating unit of the multiple input/output chip gives a pulse width modulating signal (PWM signal) for varying pulse width according to a duty factor such as duty cycle determined by the control processing unit of the microprocessor to the corresponding motor driving unit. The control processing unit of the microcomputer calculates a duty factor by using a position command pulse signal provided by the command unit, and a count counted by each up/down counter (the current positions of the needle and the motor) and gives the calculated duty factor to the multiple input/output chip.

The foregoing prior art, however, takes nothing into consideration about a method of calculating a position command by the command unit of the microcomputer. If position commands for the plurality of motors are calculated sequentially and repeatedly by the common microcomputer, a long time is necessary for one calculation cycle for calculating position commands for all the motors, i.e., tens or hundreds of motors and, consequently, control speed is reduced such that the calculation is unable to be synchronized with the movement of the yarn feeder. Therefore, in the prior art, the one controller is able to control only a small number of motors.

Accordingly, it is an object of the present invention to reduce the storage capacity of a storage device storing control data for controlling a plurality of motors and to achieve the control of a plurality of needle driving motors in quick response synchronous with the travel of a yarn feeder.

SUMMARY OF THE INVENTION

A motor control method and a motor controller in accordance with the present invention are applied to a knitting machine provided with a plurality of needle driving units each provided with a needle driving motor.

In a motor control method according to the present invention, a plurality of position control patterns representing the relation between the position of a yarn feeder and positions of needles, i.e., displacements of the needles, and knitting data including pattern codes specifying the position control patterns for each needle and every course are stored previously in a storage means, such as an internal storage and an external storage. A processing means, such as a control computing element or a comparison computing element, reads a position control pattern specified by a pattern code during knitting operation, periodically determines a desired or target position for each motor on the basis of the read position control pattern and the current position of the yarn feeder, and gives a driving signal corresponding to the difference between the current position and the determined target position of each motor to the corresponding needle driving unit.

A motor controller according to the present invention comprises a processing means which stores a plurality of position control patterns representing the relation between the position of a yarn feeder and positions of needles, i.e., displacements of the needles, and knitting data including pattern codes specifying the position control patterns for each needle and every course, reads a position control pattern specified by a pattern code, periodically determines a target position for each motor which drives each needle and therefore is representative of the position of each needle on the basis of the read position control pattern and the current position of the yarn feeder, and provides a signal representing the determined target position of each motor, and a command means which provides a driving signal corresponding to the difference between the current position of each motor and the target position provided by the processing means to a corresponding needle driving unit.

The position control pattern for each needle and every course can be read by using a pattern code included in the knitting data and read from the knitting data. The position control pattern may be, for example, a pattern representing the relation between the position of the yarn feeder measured on the horizontal (or the vertical) axis and the position of the needle measured on the vertical (or the horizontal) axis. The target position can be obtained by, for example, reading the position of the needle corresponding to the current position of the yarn feeder from the position control pattern.

According to the present invention, the plurality of position control patterns and the knitting data are stored previously, and the position control pattern is read by using the pattern code included in the knitting data during knitting operation. Therefore, the plurality of needles are able to share the position control patterns. Consequently, the storage capacity of the storage for storing the position control patterns may be smaller than that of a storage for storing position commands like the position control patterns for each needle and every course, and time necessary for producing the position control patterns is reduced remarkably.

According to the present invention, since the target position of each motor is determined periodically on the basis of the read position control pattern and the current position of the yarn feeder, the plurality of needle driving motors can quickly be controlled in synchronism with the travel of the yarn feeder by the common processing means.

Each position control pattern representing the position of the needle corresponding to each position of the yarn feeder in a fixed range ($X_0$–$X_T$) for a fixed distance $\Delta X_s$) is stored, a position (XN–$\alpha$) of the yarn feeder corresponding to the origin ($X_0$) of the fixed range is determined for each needle, and the coordinates of the position of the yarn feeder included in the read position control pattern can be corrected by using the determined position of the yarn feeder ($X_0$= XN–$\alpha$). The capacity of the storage unit necessary for storing the position control pattern may be smaller than that necessary for storing continuous curves representing the position control patterns.

The processing means executes an operation using the following expression where $X_R$ is a position of the yarn feeder when determining the target position, $X_n$ is a position of the yarn feeder storing a position of a needle, and preceding the position $X_R$ in the position control pattern, $P_1$ is a needle position for the position $X_n$, $X_{n+1}$ is a position of the yarn feeder storing the needle position after the position $X_R$ in the position control pattern, $P_2$ is a needle position for the position $X_{n+1}$ and $\Delta X_S$ is the distance between the position $X_n$ and the position $X_{n+1}$, to determine the target position $P_R=P_1+P_m$ for the position $X_R$. Thus, the target position can correctly be determined despite a small storage capacity used by the storage unit for storing one position control pattern.

$$P_m=\{(P_2-P_1)(X_R-X_n)\}/\Delta X_S$$

In a preferred embodiment, the command means comprises a control circuit which compares the current position of the needle of each motor and a target position periodically and provides a control signal proportional to the difference between the current position and the target position for each motor, and a plurality of input/output circuits which corresponds to the motors, respectively, receive control signals from the control circuit and give driving signals corresponding to the received control signals to the corresponding needle driving units.

BRIEF DESCRIPTION OF THE DRAWINGS

FIGS. 2(A) and (B) are tables of an example of a portion of knitting data;

DESCRIPTION OF THE PREFERRED EMBODIMENTS

Figure 1:
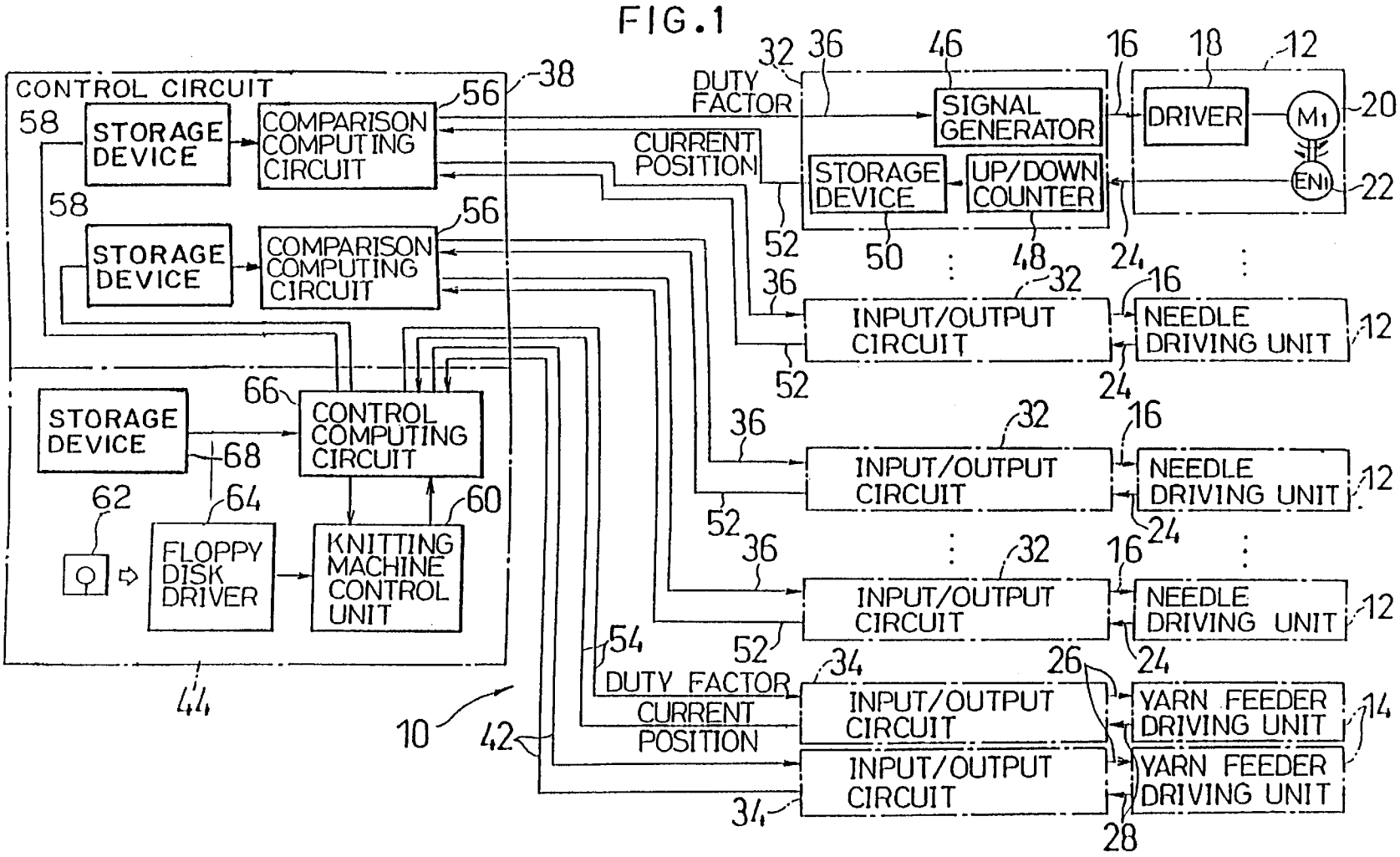
FIG. 1 is a block diagram of an example of an electric circuit of a knitting machine provided with a motor controller in a preferred embodiment according to the present invention.

Referring to FIG. 1, a motor controller 10 is applied to a knitting machine provided with a plurality of needle driving units 12 for reciprocating needles, and a plurality of yarn feeder driving units 14 for reciprocating a yarn feeder. Each needle driving unit 12 reciprocate a corresponding needle. Therefore, the number of the needle driving units 12 is equal to that of the needles of the knitting machine, such as 384×2.

Each needle driving unit 12 has a driver 18 which receives a driving signal 16 from the motor controller 10 and drives a needle driving motor 20 by the received driving signal. A detector 22 detects a displacement of the motor 20 and gives a number of pulse signals 24 corresponding to the displacement to the motor controller 10. The motor 20 is a reciprocating or rotary electric motor, such as a linear motor, a servomotor or a stepping motor.

If the motor 20 is a linear motor, the detector 22 may be a linear position sensor which provides a pulse signal every time a moving element moves a fixed distance. The linear position sensor is a magnetic sensor having a magnetic sensing head which detects N poles and S poles formed on an elongate member in a longitudinally alternate arrangement and provides pulse signals 24, or an optical sensor having an optical sensing head which detects optical marks like bars of a bar code formed in a longitudinal arrangement at intervals on an elongate member as a moving element moves and provides pulse signals 24.

If the motor 20 is a rotary motor, the detector 22 may be a rotary position sensor which provides a pulse signal every time a rotor turns through a fixed angle. The rotary position sensor is a rotary encoder. If the motor 20 is a rotary electric motor, the needle driving unit is provided with a motion converting mechanism for converting the rotary motion of the electric motor into a reciprocating motion.

The detector 22 generates a pulse signal capable of signifying the direction of a linear motion when the motor 20 is of a linear type or a pulse signal capable of signifying the direction of a rotary motion when the motor 20 is of a rotary type.

Each yarn feeder driving unit 14 corresponds to a yarn feeder for feeding a yarn and is similar in configuration to the needle driving unit 12. Although only two yarn feeder driving units 14 are shown in FIG. 1, the number of the yarn feeder driving units 14 is equal to that of the yarn feeders of the knitting machine. Therefore, each yarn feeder driving unit 14 receives a driving signal 26 from the motor controller 10 and gives a pulse signal 28 having a number of pulses corresponding to the displacement of the yarn feeder to the motor controller 10.

The motor controller 10 comprises a plurality of input/output circuits 32 to apply driving signals 16 to the needle driving units 12, and a plurality of input/output circuits 34 to apply driving signals 26 to the yarn feeder driving units 14, a control circuit 38 to apply control signals 36 to the input/output circuits 32, and an arithmetic circuit 44 for giving target or target position signals 40 indicating desired or target positions of the needles, i.e., desired or target positions of the motors, to the control circuit 38 and giving control signals 42 to the input/output circuits 34.

Each input/output circuit 32 is combined with each needle driving unit 12, and each input/output unit 34 is combined with each yarn feeder driving unit 14. The driving signals 16 and 26 are pulse signals having pulse widths, i.e., duty factors, corresponding to the duration of current supply to the motors 20, the control signals 36 and 42 are binary signals specifying duty factors, and the target position signals 40 are binary signals specifying the raised positions of the needles, i.e., target positions of the motors.

Each input/output circuit 32 has a signal generator 46 which receives the control signal 36 from the control circuit 38, an up/down counter 48 which receives the pulse signal 24 from the position sensor 22, and a storage device 50 which reads the count value of the up/down counter 48 periodically and stores the same temporarily. Data stored in the storage device 50 is a current position signal 52 indicating the current position of the motor 20. The current position signal 52 is read periodically by the control circuit 38.

The signal generator 46 gives a driving signal 16, i.e., a PWM signal produced by modulating the pulse width of a pulse signal having a fixed frequency by the control signal 36, to the driver 18. Then, the driver 18 supplies a current to the motor 20 for a time corresponding to the pulse width of the driving signal 16 every time the driving signal 16 is applied thereto. The up/down counter 48 counts up upon the reception of the pulse signal 24 when the motor 20 is rotating in the normal direction, and counts down upon the reception of the pulse signal 24 when the motor 20 is rotating in the reverse direction. The contents of the storage device 50 may be updated every time the up/down counter 48 counts up or down.

Configuration and functions of each input/output circuit 34 are the same as those of the input/output circuit 32, except that the input/output circuit 34 gives a current yarn feeder position signal 54 indicating the current position of the yarn feeder to the arithmetic circuit 44. Each input/output circuit 34 gives a driving signal 26 produced by modulating the pulse width of a pulse signal of a fixed frequency according to the control signal 42 to the yarn feeder driving circuit 14, and receives a pulse signal 28 having a number of pulses corresponding to the displacement of the yarn feeder from the yarn feeder driving unit 14.

The control circuit 38 comprises two comparison computing elements, i.e., circuits, 56 which generate the control signals 36, and two storage devices 58 for temporarily storing a plurality of target position signals 40 for the needle driving units 12 provided by the arithmetic circuit 44. One of the sets of the comparison computing element 56 and the storage device 58 is associated with the needles arranged on a front needle bed and is connected to the input/output circuits 32 for those needles, and the other set is associated with the needles arranged on a back needle bed and is connected to the input/output circuits 32 for those needles.

Each comparison computing element 56 reads a target position signal 40 for the predetermined needle driving unit 12 among the plurality of target position signals 40 stored in the corresponding storage device 58, and a current position 52 stored in the storage device 50 of the input/output circuit 32 corresponding to the predetermined needle driving unit 12, compares the read target position signal 40 and the read current position 52, calculates a duty factor corresponding to the difference between the target position signal 40 and the current position 52, and gives a control signal 36 representing the duty factor to the signal generator 46 of the corresponding input/output circuit 32. These operations are executed periodically, for example, every 1 ms, for each needle. The data stored in the storage device 58 is updated every time the target position signal 40 is given to the storage device 58 by the arithmetic circuit 44.

The arithmetic circuit 44 comprises a knitting machine control unit 60 for controlling the general operations of the knitting machine, a disk drive 64 which reads knitting data from a floppy disk 62 and gives the same to the knitting machine control unit 60, a control computing element, i.e., circuits 66 which exchanges data with the knitting machine control unit 60, and a storage device 68 wherein a plurality of position control patterns are stored.

The knitting data includes codes specifying position control patterns for each needle and every course, and codes specifying the yarn feeders to be used for knitting and moving directions of the yarn feeders for every course. For example, the knitting data may be tables as shown in FIGS. 2(A) and 2(B) respectively for the yarn feeders. Although not shown, the knitting data includes control information, i.e., control data, for controlling driving units other than the needle driving units and the yarn feeder driving units, such as needle bed driving units for shifting the needle beds.

In FIG. 2, patterns A and B are codes specifying position control patterns A and B, respectively. Actually, the patterns A and B are stored in binary codes. Although only the two position control patterns are shown in FIG. 2, some products need more than two position control patterns.

Figure 3:
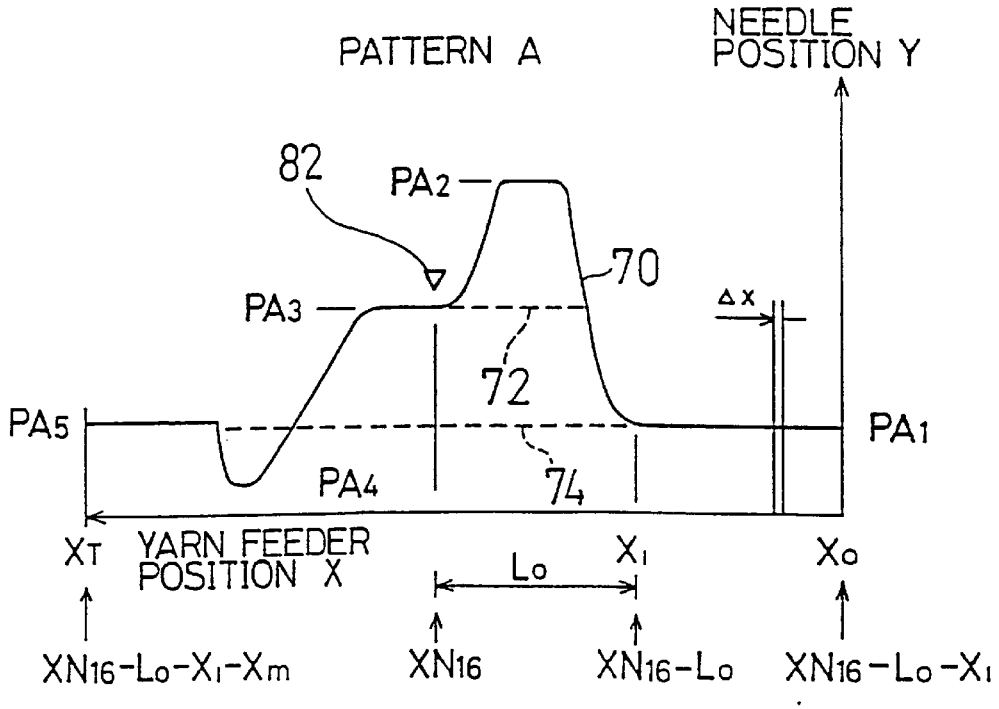
FIG. 3 is a diagram showing an example of a position control pattern.
Figure 4:
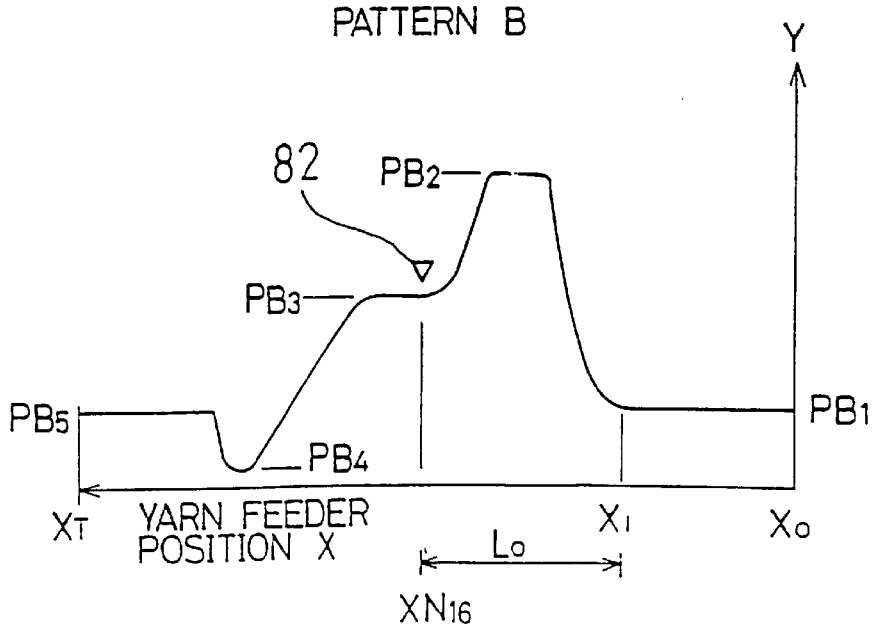
FIG. 4 is a diagram showing another example of a position control pattern.

As shown in FIGS. 3 to 6 by way of example, the position control pattern is represented by a diagram obtained by measuring needle position with respect to the edge of the bed, i.e., a displacement of the needle point from the needle bed edge, on the vertical axis and measuring yarn feeder position on the horizontal axis. FIG. 3 shows one common knit pattern (pattern A), and FIG. 4 shows another common pattern (Pattern B).

In the common knit patterns shown in FIGS. 3 and 4, the needles at the standby positions, i.e., origins $PA_1$ and $PB_1$ are raised to positions $PA_2$ and $PB_2$, where the needles are separated from the yarns, the needles are lowered to positions $PA_3$ and $PB_3$, where needles catch the yarns, the needles are lowered further to positions $PA_4$ and $PB_4$, where stitches are formed, and then the needles are raised to positions $PA_5$ and $PB_5$ corresponding to the origin $PA_1$. For example, maximums of the displacements $PA_2$–$PA_4$ and $PB_2$–$PB_4$ of the needles and maximums $PA_1$–$PA_4$ and $PB_1$–$PB_4$ of the stitch lengths may be 40 mm and 10 mm, respectively. Naturally, different position control patterns are determined for different displacements of the needles and different stitch lengths.

Figure 5:
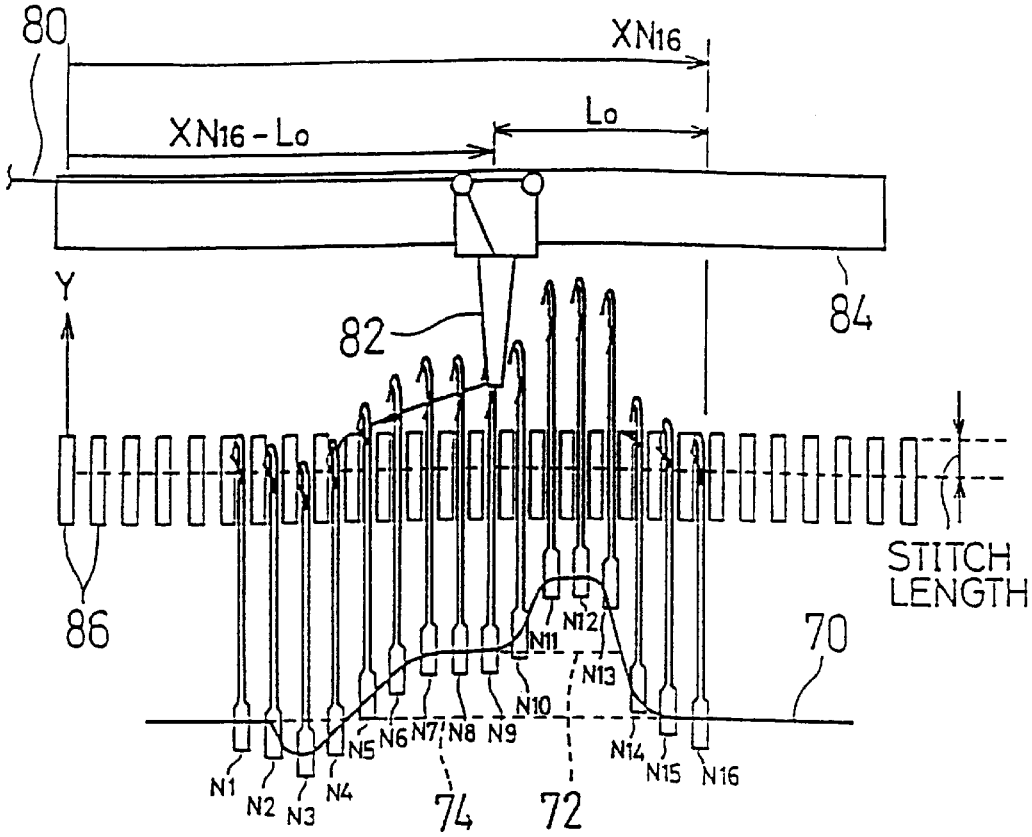
FIG. 5 is a view showing the relation between the positions of needles and the position of a yarn feeder, and a position control pattern.

In FIG. 5, a common knit pattern 70 is indicated by a continuous line, and a tuck pattern 72 for tucking and a welt pattern 74 for keeping the needles at an inoperative position are indicated by broken lines. The tuck pattern 72 does not raise the needle to the position $PA_2$(or $PB_2$) and is similar to the knit pattern 70, except that the tuck pattern 72 raises the needle to the position $PA_3$(or $PB_3$) as indicated by a broken line. The welt pattern 74 does not move the needle from the origin $PA_1$.

Also shown in FIG. 5 are a yarn 80, a yarn feeder 82 through which the yarn 80 is fed, a guide 84 for guiding the yarn feeder 82, a plurality of sinkers 86 and a plurality of needles $N_1$ to $N_{16}$. The yarn feeder 82 is moved from an original position (reference position) at the left end of the knitting machine to the right or from an original position at the right end of the knitting machine to the left.

Figure 6:
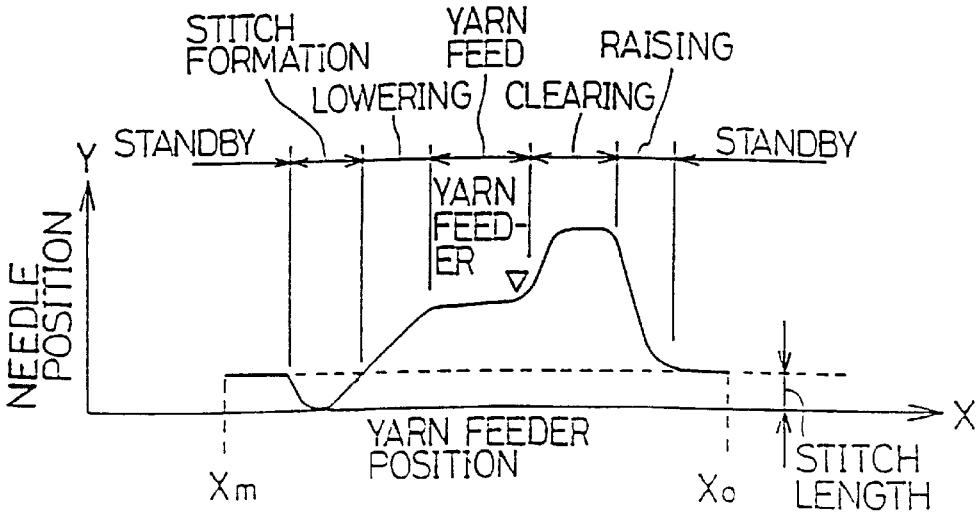
FIG. 6 is a diagram showing positions of a needle on a position control pattern.

The position control pattern shown in FIG. 5 shows the positions of the needles $N_1$ to $N_{16}$ when the yarn feeder 82 is moved from the left end to the right. The position control patterns shown in FIGS. 3, 4 and 6 show the relation between the position of the yarn feeder and a locus along which the needle is to be moved when the yarn feeder is moved from the right end to the left.

As shown in FIGS. 3, 4 and 7, each position control pattern is stored in positions of the needle corresponding to positions of the yarn feeder at every fixed interval $\Delta X_S$ in a fixed range of $X_0$ to $X_T$ narrower than a range in which the yarn feeder can be moved, for example, positions of the yarn feeder at every interval $\Delta X_S$ from the origin $X_0$ or positions of the yarn feeder at every distance $\Delta X_S$ from the needle in a fixed range.

If the position control pattern is expressed in the foregoing manner, a storage capacity of the storage device necessary for storing the position control pattern is smaller than that necessary for storing the position control pattern expressed by a continuous curve, and the position control pattern can be shared by a plurality of needles.

The knitting machine control unit 60 has an internal storage for storing knitting data provided by the disk drive 64, and controls the driving units other than the needle driving units 12 and the yarn feeder driving units 14 according to the knitting data. The knitting machine control unit 60 reads knitting data shown in FIGS. 2(A) and 2(B) including the position control pattern for each yarn feeder and each needle every course and gives the same to the control computing element 66.

The control computing element 66 reads a position control pattern for each needle every course on the basis of the knitting data received from the knitting machine control unit 60, calculates a yarn feeder position X (distance from the origin), determines a target position of the needle on the basis of the calculated yarn feeder position X and the read position control pattern, gives the determined target position to the predetermined storage device 58. These operations are executed periodically (for example, every 1 ms) every course and for each needle.

Thus, the contents of the storage device 58 are updated periodically. Therefore, the comparison computing element 56 calculates a new duty factor, the comparison computing element 56 gives a new control signal 36 to the signal generator 46, and a new driving signal 16 is given to the driver. Consequently, each needle is raised and lowered in synchronism with the movement of the yarn feeder.

The control computing element 66 controls the position of the yarn feeder. The control computing element 66 multiplies time elapsed since the start of movement of the yarn feeder by the set traveling speed of the yarn feeder (for example, 70 cm/s) to calculate the target position of the yarn feeder, compares the calculated target position with the current position 54 of the yarn feeder received from the input/output circuit 34, calculates a duty factor, and gives a control signal 42 corresponding to the calculated duty factor to the input/output circuit 34. These operations are executed periodically (for example, every 1 ms) for every course and for each yarn feeder.

A new driving signal 26 is given from the input/output circuit 34 to the corresponding yarn feeder driving unit 14 every time the foregoing operations are executed.

A method of calculating a target position for the needle $N_{16}$ as a representative needle by the control computing element 66 will be described.

Suppose that each position control pattern is expressed by needle positions corresponding to yarn feeder positions at every fixed interval $\Delta X_S$ (for example, 1 mm) in the fixed range of $X_0$ to $X_T$ narrower than the range in which the yarn feeder can be moved, the needle $N_{16}$ is at a distance $XN_{16}$ from the original position of the yarn feeder, and the needle $N_{16}$ starts moving when the distance between the yarn feeder and the needle $N_{16}$ is $L_0$. Then, the control computing element 66 calculates the target position of the needle $N_{16}$ by the following method.

First, the control computing element 66 reads a position control pattern for the course and each needle from the knitting data. With a position control pattern for a needle $N_{26}$, a yarn feeder position corresponding to the origin $X_0$ on the horizontal axis of the position control pattern for the needle $N_{16}$, i.e., an offset, is determined, the abscissa $X_0$ of the position control pattern is corrected to the abscissa $(XN_{16}-L_0-X_1)$ of the needle $N_{16}$, and the original position $PA_1$ of the needle is provided as a target position until the current yarn feeder position provided by the input/output circuit 34 reaches $(XN_{16}-L_0)$. The value $L_0-X_1$ may be substituted by $\alpha$.

Upon the movement of the yarn feeder beyond the position $(XN_{16}-L_0)$, the control computing element 66 provides a value greater than $PA_1$ as a target position to raise the needle to a position $PA_2$. The control computing element 66 provides a predetermined target position according to the current position of the yarn feeder, and the position control pattern in a state after the correction of the abscissa.

While the position control pattern represents positions of the needle corresponding to positions of the yarn feeder at every fixed interval $\Delta X_S$ (for example, 1 mm), a target position of the needle is calculated periodically (for example, every 1 ms). Therefore, in most cases, the position of the needle for the position of the yarn feeder at a moment when a target position is to be calculated is not set in the position control pattern.

For example, if the target position calculating period is 1 ms and the traveling speed of the yarn feeder is 70 cm/sec, the yarn feeder travels a distance (X=0.7 mm) in the target position calculating period. The distance varies with the variation of the traveling speed of the yarn feeder. In most cases, a needle position $P_R$ corresponding to a yarn feeder position $X_R$ at which a target position is to be calculated is not set in the position control pattern as shown in FIG. 7.

Figure 7A:
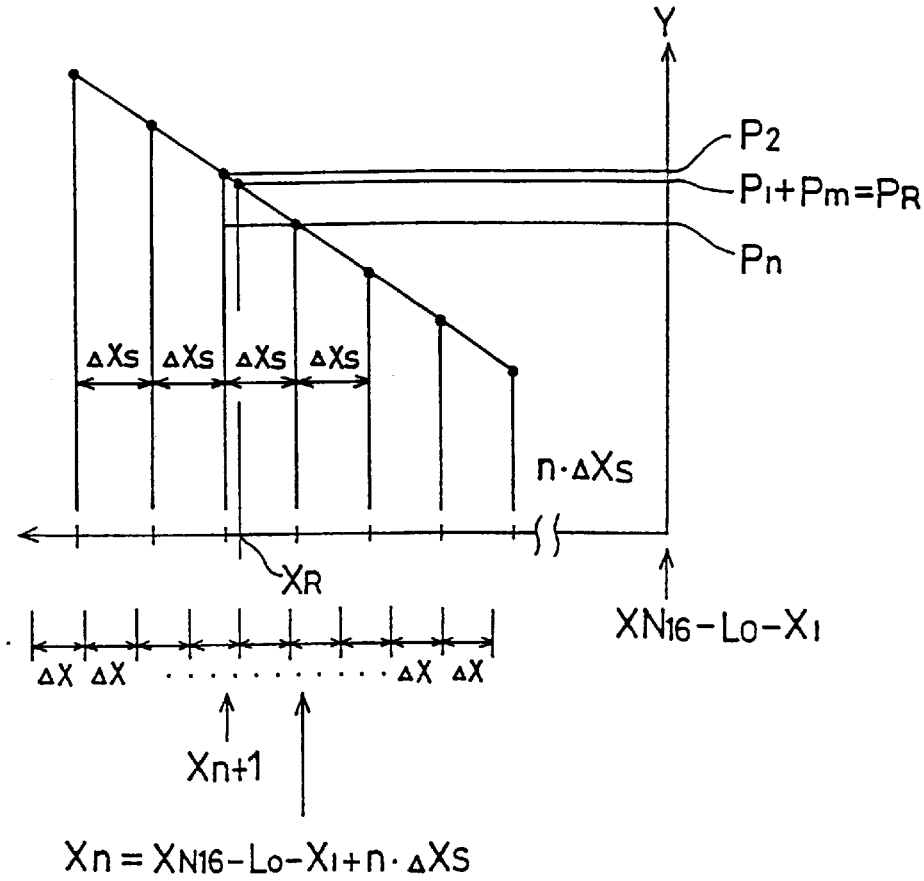
FIGS. 7(A) and (B) are diagrammatic views of assistance in determining a target position by interpolation.
Figure 7B:
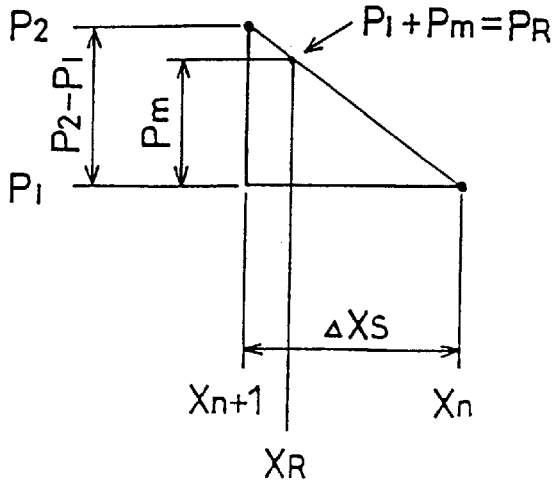

Therefore, the control computing element 66 carries out calculation by using Expression (1) to determine the target position $P_R=P_1+P_m$ at the position $X_R$ by interpolation as shown in FIGS. 7(A) and 7(B).

In Expression (1), $X_R$ is a yarn feeder position at which a target position is to be determined, $X_n$ is a yarn feeder position before the position $X_R$ on a position control pattern, storing a needle position, $P_1$ is a needle position corresponding to the position $X_n$, $X_{n+1}$ is a yarn feeder position after the position $X_R$ on a position control pattern, storing a needle position, $P_2$ is a needle position corresponding to the position $X_{n+1}$, and $\Delta X_S$ is the distance between the positions $X_n$ and $X_{n+1}$.

$$P_m=\{(P_2-P_1)(X_R-X_n)\}/\Delta X_S \quad (1)$$

In FIGS. 7(A) and 7(B), Expression (2) holds good, Expression (1) is obtained and hence $P_1+P_m$ can be regarded as the target position $P_R$ corresponding to the position $X_R$.

$$(P_2-P_1):P_m=\Delta X_S:(X_R-X_n)$$

The control computing element 66 carries out the foregoing operation for all the needles for which position control patterns are set.

A correct target position can be determined by the foregoing interpolation even if a small storage capacity is available for storing one position control pattern. The interpolation may be omitted by reducing the distance $\Delta X_S$, which, however, increases storage capacity necessary for storing one position control pattern. If the yarn feeder position $X_R$ for determining a target position is not equal to a yarn feeder position for which a needle position is set previously, a needle position corresponding to a yarn feeder position $X_N$ nearest to the yarn feeder position $X_R$ may be used as a target position.

The motor controller 10 is able to control the plurality of needle driving motors quickly in synchronism with the travel of the yarn feeder by the common processing means. The position control pattern can be used for controlling the plurality of needles and, therefore, the storage capacity of the storage device for storing the position control patterns may be smaller than that of a storage device for storing position control patterns for the needles and for courses and time necessary for producing the position control pattern can remarkably be reduced.

The present invention is not limited in its practical application to the foregoing embodiment. For example, the distance between the needle and the yarn feeder may be measured on the horizontal axis of the diagram showing the position control pattern.

What is claimed is:

1. A motor control method for controlling the position of each needle along a course of a knitting machine provided with a plurality of needle driving units which drive the needles and have needle driving motors, said motor control method comprising:

storing a plurality of predetermined position control patterns representing the relation between the position of a yarn feeder and that of a needle, and storing predetermined knitting data including pattern codes specifying the position control patterns, for each needle and defining a pattern for every course;

reading a position control pattern specified by the pattern code in the knitting data during a knitting operation;

periodically determining a target position for the needle of a needle driving motor on the basis of the read position control pattern and the current position of the yarn feeder; and giving a driving signal to the needle driving motor corresponding to the difference between the current position of the needle associated with the needle driving motor and the determined target position for the needle to its corresponding needle driving unit.

2. The motor control method according to claim 1 further comprising determining the position of the yarn feeder corresponding to the origin of each position control pattern for each needle, and correcting the coordinates of the position of the yarn feeder in the read position control pattern in connection with the position of the yarn feeder that was determined, wherein the position control patterns which were previously stored represent the positions of the needles corresponding to positions of the yarn feeder for a fixed distance in a fixed range.

3. A motor controller for controlling the position of each needle of a knitting machine provided with a plurality of needle driving units including needle driving motors, each with a needle, said motor controller comprising:

a processing means for storing a plurality of predetermined position control patterns representing the relation between the position of a yarn feeder and each needle, for storing knitting data including pattern codes specifying the position control patterns for each needle and every course, for reading a position control pattern specified by the pattern code during a knitting operation, for periodically determining target positions for the needles of each needle driving motor on the basis of the read position control pattern and the current position of the yarn feeder, and for providing a signal representing the determined target position; and a command means for providing a driving signal to each needle drive motor corresponding to the difference between the current position and the target position for the needle of each needle drive motor.

4. The motor controller according to claim 3, wherein the stored position control patterns represent the positions of the needles corresponding to positions of the yarn feeder for a predetermined distance in a predetermined range, and the processing means is further adapted to determine the position of the yarn feeder corresponding to the origin of each position control pattern for each needle, and to correct the coordinates of the position of the yarn feeder in the read position control pattern in connection with the determined position of the yarn feeder.

5. The motor controller according to claim 3, wherein the processing means executes an operation to determine the difference $P_m$ between the current position and the target position for the needle of each needle driving motor by using:

$$P_m=\{(P_2-P_1)\ (X_R-X_n)\}/\Delta X_S$$

where $X_R$ is a position of the yarn feeder when determining the target position, $X_n$ is a position of the yarn feeder storing a position of a needle, and preceding the position $X_R$ in the position control pattern, $P_1$ is a needle position for the position $X_n$, $X_{n+1}$ is a position of the yarn feeder storing the needle position after the position $X_R$ in the position control pattern, $P_2$ is a needle position for the position $X_{n+1}$, and $\Delta X_S$ is the distance between the position $X_n$ and the position $X_{n+1}$.

6. The motor controller according to claim 3, wherein the command means comprises (a) a control circuit which compares the current position of a needle associated with each motor with the target position thereof, and outputs for each motor a driving control signal proportional to the difference between the current position and the target position, and (b) a plurality of input/output circuits in communication with the motors, which receive the driving signals, and transmit displacement signals from the motors corresponding to the position of the needle of each needle driving motor.

* * * * *